US009967667B2

(12) United States Patent
Wang et al.

(10) Patent No.: US 9,967,667 B2
(45) **Date of Patent: *May 8, 2018**

(54) METHOD AND SYSTEM FOR AUDIO BROADCAST USING LIGHTING DEVICES

(71) Applicant: ZHEJIANG SHENGHUI LIGHTING CO., LTD, Jiaxing (CN)

(72) Inventors: Xia Wang, Jiaxing (CN); Chaoqun Sun, Jiaxing (CN); Jinxiang Shen, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/720,967

(22) Filed: Sep. 29, 2017

(65) Prior Publication Data

US 2018/0027327 A1 Jan. 25, 2018

Related U.S. Application Data

(63) Continuation-in-part of application No. 14/902,035, filed as application No. PCT/CN2015/077073 on Apr. 21, 2015, now Pat. No. 9,807,506.

(30) Foreign Application Priority Data

Aug. 26, 2014 (CN) ..... 2014 1 0424355

(51) Int. Cl.
*H04R 3/00* (2006.01)
*H04R 3/12* (2006.01)
(Continued)

(52) U.S. Cl.
CPC ..... *H04R 3/12* (2013.01); *F21V 33/0056* (2013.01); *H04R 27/00* (2013.01); *H04R 2227/005* (2013.01)

(58) Field of Classification Search
CPC .. H04R 1/028; H04R 27/00; H04R 2227/005; H04R 2420/07; H04R 3/12; F21V 33/00
See application file for complete search history.

(56) References Cited

U.S. PATENT DOCUMENTS

| | | | |
|---|---|---|---|
| 8,282,227 | B2 | 10/2012 | Massara et al. |
| 2005/0197113 | A1 | 9/2005 | Lin |
| 2009/0271002 | A1 | 10/2009 | Asofsky |

FOREIGN PATENT DOCUMENTS

| | | | |
|---|---|---|---|
| CN | 103108454 | A | 5/2013 |
| CN | 103501558 | A | 1/2014 |

(Continued)

OTHER PUBLICATIONS

The World Intellectual Property Organization (WIPO) International Search Report for PCT/CN2015/077073 dated Jul. 28, 2015.

*Primary Examiner* — Muhammad N Edun
(74) *Attorney, Agent, or Firm* — Anova Law Group, PLLC

(57) ABSTRACT

The present disclosure provides an audio broadcast system and method. The audio broadcast system includes a primary device including a primary wireless communication module and an audio broadcast module; and one or more secondary devices each including a secondary wireless communication module and an audio broadcast module. The primary device and the one or more secondary devices form a wireless transmitting linking path. The primary device is configured to receive a first audio data from an external device, and to send the first audio data to the one or more secondary devices by using the primary wireless communication module. Further, the secondary wireless communication module is configured to receive the first audio data from the primary device or from a different connecting secondary device; and (Continued)

the audio broadcast modules of the primary device and the one or more secondary devices are configured to broadcast the first audio data.

19 Claims, 2 Drawing Sheets

(51) Int. Cl.
*F21V 33/00* (2006.01)
*H04R 27/00* (2006.01)

(56) References Cited

FOREIGN PATENT DOCUMENTS

| | | | |
|---|---|---|---|
| CN | 103533716 | A | 1/2014 |
| CN | 203554727 | U | 4/2014 |
| CN | 203645815 | U | 6/2014 |
| CN | 103925583 | A | 7/2014 |
| CN | 104197300 | A | 12/2014 |

METHOD AND SYSTEM FOR AUDIO BROADCAST USING LIGHTING DEVICES

CROSS-REFERENCES TO RELATED APPLICATIONS

This application is a continuation-in-part application of U.S. patent application Ser. No. 14/902,035, filed on Dec. 30, 2015. U.S. patent application Ser. No. 14/902,035 is a national phase entry under 35 USC § 371(c) of PCT Application No. PCT/CN2015/077073, filed on Apr. 21, 2015, which claims the priority of Chinese Patent Application No. 201410424355.3, filed on Aug. 26, 2014, the entire content of all of which are incorporated herein by reference.

FIELD OF THE DISCLOSURE

The present disclosure generally relates to the field of audio broadcasting technologies and, more particularly, relates to an audio broadcast method and system.

BACKGROUND

Currently, a smart terminal may employ Bluetooth technology to instruct a wireless audio broadcast device play music from the smart terminal. However, when there are multiple wireless audio broadcast devices, a specific wireless transmitter station is required to control and send audios, so that the music in the smart terminal can be played. However, such specific wireless transmitter station is bulky and expensive, and may not be compatible with different models of smart terminals. In addition, since the specific wireless transmitter station must be used, each wireless audio broadcast device may only play same music from a connected smart terminal, which limits application scenarios of the smart devices with audio broadcast capabilities.

The disclosed method and system for audio broadcast are directed to solve one or more problems set forth above and other problems in the art.

BRIEF SUMMARY OF THE DISCLOSURE

One aspect of the present disclosure provides an audio broadcast system. The audio broadcast system includes a primary device including a primary wireless communication module and an audio broadcast module; and one or more secondary devices each including a secondary wireless communication module and an audio broadcast module. The primary device and the one or more secondary devices are connected to form a wireless transmitting linking path through the primary wireless communication module of the primary device and one or more secondary wireless communication modules of the one or more secondary devices. The primary device is configured to receive a first audio data from an external device, and to send the first audio data to the one or more secondary devices by using the primary wireless communication module. Further, the secondary wireless communication module of each of the one or more secondary devices is configured to receive the first audio data from the primary device or from a different connecting secondary device; and the audio broadcast modules of the primary device and the one or more secondary devices are configured to broadcast the first audio data.

Another aspect of the present disclosure provides an audio broadcast method. The method includes: providing a primary device including a primary wireless communication module and an audio broadcast module and one or more secondary devices each including a secondary wireless communication module and an audio broadcast module, wherein the primary device and the one or more secondary devices are connected to form a wireless transmitting linking path through the primary wireless communication module of the primary device and one or more secondary wireless communication modules of the one or more secondary devices; receiving, by the primary device, a first audio data from an external device; sending, by the primary wireless communication module of the primary device, the first audio data to the one or more secondary devices through the wireless transmitting linking path; receiving, by the secondary wireless communication module of at least one of the one or more secondary devices, the first audio data from the primary device or from a different secondary device of the one or more secondary devices, connected to the at least one secondary device; and broadcasting, by the audio broadcast modules of the primary device and the one or more secondary devices, the first audio data.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

The disclosed methods and systems for audio broadcast may solve technical problems related to using bulky and expensive specific wireless transmitter station to play music stored in a smart terminal connected to smart appliances having audio broadcasting capabilities. The smart appliances can be any smart appliances used in homes or offices, for example, a lighting device (or a lamp), a smart TV, a wireless speaker, a smart refrigerator, a smart alarm, etc. Each smart appliance in the audio broadcast system is embedded with a wireless communication module and an audio broadcast module. The wireless communication module may be a Bluetooth module, a Wi-Fi module, or include both the Bluetooth module and the Wi-Fi module. Types of the smart appliances are not limited herein. For example, the disclosed audio broadcast system includes a plurality of smart appliances having wireless communication and audio broadcasting capabilities. The plurality of smart appliances includes a primary device, and at least one secondary device. For example, the system may include a first lighting device, a second lighting device and a wireless speaker; the second lighting device may be the primary device, the remaining two appliances may function as the secondary devices.

Specifically, the disclosed methods and systems may include a primary device and secondary device(s) to form a wireless transmitting linking path via wireless communication modules in some or all devices. When receiving one or more audio data, the wireless communication module of the primary device may transmit the audio data to the secondary device(s). Therefore, any one(s) of the primary device and the secondary device(s) may play the same or different audio data without using conventional bulky and expensive specific wireless transmitter station, such that the disclosed systems and methods may be widely used in various applications as desired.

Figure 1A:
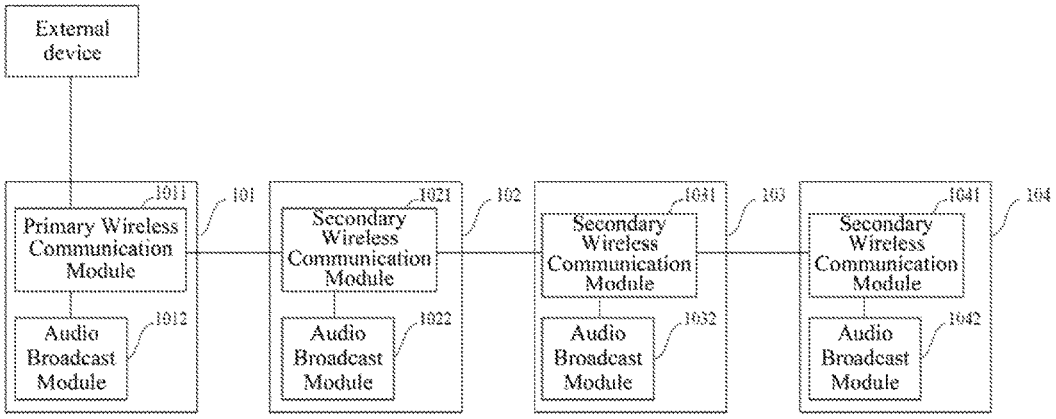
FIG. 1A is a system diagram illustrating an exemplary audio broadcast system consistent with various embodiments of the present disclosure.
Figure 1B:
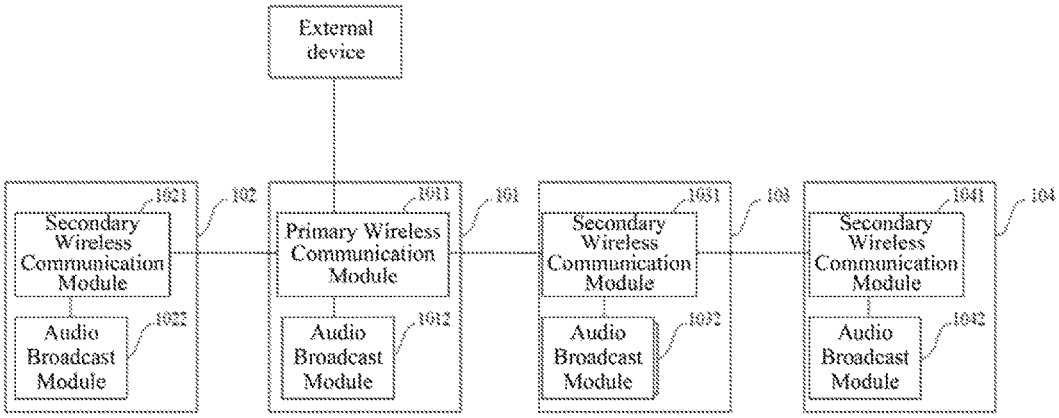
FIG. 1B is a system diagram illustrating another exemplary audio broadcast system consistent with various embodiments of the present disclosure.

FIGS. 1A and 1B illustrate exemplary audio broadcast systems consistent with various embodiments of the present disclosure. As shown in FIGS. 1A and 1B, the disclosed audio broadcast system includes a primary device 101 and one or more secondary devices 102-104. The primary device 101 includes a primary wireless communication module 1011 and an audio broadcast module 1012. Each secondary device (e.g., 102) includes a secondary wireless communication module (e.g. 1021) and a corresponding audio broadcast module (e.g., 1022). Specifically, the primary device 101 and the one or more secondary devices (e.g., 102, 103, 104) are connected to form a wireless transmitting linking path through the primary wireless communication module 1011 of the primary device and one or more secondary wireless communication modules (e.g., 1021, 1031, 1041) of the one or more secondary devices.

The primary wireless communication module 1011 and the secondary wireless communication modules 1021-1041 may be a Bluetooth module, a Wi-Fi module, or a communication module having both Bluetooth and Wi-Fi connection functionalities. The audio broadcast modules (e.g., 1012, 1022, 1032, 1042) of the primary device and the one or more secondary devices are configured to play audio data received from its corresponding communication module.

In an exemplary embodiment, the primary wireless communication module 1011 is configured to receive a first audio data from an external device, and to send the first audio data to the one or more secondary devices. The secondary wireless communication module of each of the one or more secondary devices is configured to receive the first audio data from the primary device or from a different connecting secondary device. Further, the audio broadcast modules of the primary device and the one or more secondary devices are configured to broadcast the first audio data. It can be understood that the audio broadcast modules of different primary/secondary devices may not be the same, as long as they are compatible with the corresponding wireless communication module embedded in the appliance.

The external device may be a smart phone, a computer, a tablet, a music player, a memory card, or any other proper audio output devices. The primary device 101 may receive audio data from the external device wirelessly or through any proper connecting ports/interfaces. That is, the primary device 101 may support one or more audio input mechanisms, and the primary wireless communication module 1011 may be one of the supported input mechanisms. In one example, the external device may be wirelessly connected to the primary device through an embedded Bluetooth module, an embedded Wi-Fi module, or an embedded mobile/cellular communication module that supports 3G, 4G, and/or 5G communications. In another example, the external device may connect to the primary device through physically connected cables/ports. That is the primary device may further include an audio input unit configured to receive the first audio data from the external device through a physical connection interface. For example, the primary device may have a memory card slot, a USB connection port, an auxiliary audio input port, multi-channel analog audio input ports, and/or optic audio input port. When the primary device supports analog audio input, the primary device may further include an audio processing module to process/convert received analog audio signals to digital data, and send the digital data to the primary wireless communication module for further broadcasting.

Specifically, the primary device may include a main processing unit (e.g., a microprocessor or a microcontroller). The main processing unit may be integrated to a circuit board of the smart appliance that function as the primary device. The main processing unit may communicate with one or more audio input components embedded/integrated in the primary device to process received audio data, such as an analog audio input module, a WiFi module, a mobile/cellular communication module, an optical audio input module, and/or a multi-channel processing module. In some embodiments, the main processing unit is configured to: when the external device transmits an analog audio signal to the audio input unit or the primary wireless communication module, process the analog audio signal received by the audio input unit or the primary wireless communication module, convert the analog audio signal to digital audio data, and send the digital audio data to the primary wireless communication module for broadcasting to the one or more secondary devices. The analog audio signal may be received by the analog audio input module, a LAN module, a 3G/4G/5G module, or a multi-channel processing module. When receiving analog audio signals from different audio sources from the multi-channel processing module (e.g., through multiple ports connected to the external device), the main processing unit may process/convert the analog signals to digital data, and send the digital data to the primary wireless communication module for further broadcasting. The digital data sent to the secondary devices may be the same, or may be different based on the different audio sources. For example, the primary device may send audio signal from a first channel to one secondary device, and audio signal from a second channel to another secondary device. As such, a home theater audio system may be set up by using multiple smart appliances, such as 2.1 channel or 5.1 channel systems.

In some embodiments, the primary device may include an optical audio processing module configured to receive digital audio data (e.g., through optical audio port connected to the external device by optical cable), and send the digital audio data to the primary wireless communication module for further broadcasting. Further, when the audio broadcast modules of the secondary devices support different audio formats, the main processing unit of the primary device or corresponding secondary device may convert the audio data to proper format compatible with the audio broadcast module.

Further, besides processing received audio data, the main processing unit may also process control instruction from the external device. The control instruction may be related to the audio playing (e.g., adjusting volume) or related to main functions of the smart appliance (e.g., lighting control for a lighting device, temperature control for a fridge, clock setting for a smart alarm, etc.). The control instruction may assign any device in the audio broadcast system to perform related operations. In other words, when the external device is connected to primary device, the control instruction received by the primary device from the external device may control any one of the primary device and secondary devices.

In some embodiments, a smart appliance that directly connects (wired or wirelessly) to the external device and receives audio data from the external device may be considered as the primary device. That is, some or all smart appliance in the audio broadcast system may function as primary device and send audio data from external device to other smart appliances in the audio broadcast system. Further, multiple primary devices may exist in the audio broadcast system. For example, when a first external device is connected to the primary device 101, a second external device may connect to the secondary device 102. In this scenario, the secondary device 102 may become a primary device. In one example, the user may configure (e.g., by operating a compatible controlling application on a smart phone) some device(s) in the audio broadcast system to continue playing first audio data from the first external device, and configure other devices in the audio broadcast system to play second audio data from the second external device. In another example, device 102 may automatically take over as the primary device and all devices in the audio broadcast system may receive audio data from the second external device.

In one embodiment, all wireless communication modules in the audio broadcast system is Bluetooth module. Accordingly, the primary wireless communication module 1011 may send audio data to secondary devices through Bluetooth communication. In another embodiment, all wireless communication modules in the audio broadcast system is WiFi module. Accordingly, the primary wireless communication module 1011 may send audio data to secondary devices through WiFi communication. For example, as shown in FIG. 1A, the primary wireless communication module 1011 connects to the secondary wireless communication module 1021. The secondary wireless communication module 1031 may receive audio data from the primary wireless communication module 1011 through the to the secondary wireless communication module 1021 even when it is not in the coverage range of the primary wireless communication module 1011, as long as it is in the coverage range of the secondary wireless communication module 1021.

In another embodiment, the primary wireless communication module 1011 may include both a Bluetooth module and a WiFi module. Further, some of the secondary wireless communication modules may be a Bluetooth module, and others may be a WiFi module. In this scenario, the primary wireless communication module 1011 may use the Bluetooth module to send the audio data to secondary devices that support Bluetooth communications, and use the WiFi module to send the audio data to secondary devices that support WiFi communications. For example, as shown in FIG. 1B, the primary wireless communication module 1011 may support both Bluetooth and WiFi communications; the secondary wireless communication module 1021 may be a Bluetooth module; and the secondary wireless communication module 1031 and 1041 may be WiFi modules. Accordingly, the primary wireless communication module 1011 may send audio data to the secondary device 102 using Bluetooth communications, and send same audio data to the secondary devices 103 and 104 using WiFi communications.

Further, the primary wireless communication module 1011 may also be configured to receive audio data from the external device. That is, for example, the Bluetooth component or WiFi component of the primary wireless communication module 1011 that used for sending audio data to secondary devices may also be used to receive audio data from the external device. Alternatively, the primary wireless communication module 1011 may receive audio data through the WiFi module, and send the audio data to secondary devices through the Bluetooth module. As discussed above, the primary wireless communication module 1011 may include a Bluetooth module, a WiFi module, and/or a cellular data communication module. In some embodiments, the secondary wireless communication module may also support multiple wireless communication protocols such as WiFi, Bluetooth, and/or 3G/4G/5G communications.

Below is an embodiment of the disclosed audio broadcast system using lighting devices. It should be noted that, a lighting device in the following embodiment can be replaced with other types of smart appliances having audio broadcast and wireless communication capabilities. That is, a primary lighting device can be any smart appliance that qualifies as the primary device, and a secondary lighting device can be any smart appliance that qualifies as the secondary device. Further, a Bluetooth module can be replaced by a WiFi module or a communication module having both Bluetooth and WiFi functionalities. The audio broadcast system may include a primary lighting device 101 and one or more secondary lighting devices. For example, the audio broadcast system may include three secondary lighting devices: a first secondary lighting device 102, a second secondary lighting device 103 and a third secondary lighting device 104. Note that any number of the secondary lighting devices (e.g., more or less than three) may be included in the audio broadcast system and other devices may also be included.

The primary lighting device 101 may include a Bluetooth module 1011 and an audio broadcast module 1012. The first secondary lighting device 102 may include a Bluetooth module 1021 and an audio broadcast module 1022. The second secondary lighting device 103 may include a Bluetooth module 1031 and an audio broadcast module 1032. The third secondary lighting device 104 may include a Bluetooth module 1041 and an audio broadcast module 1042.

The primary lighting device 101 may use the Bluetooth module 1011 to connect to the Bluetooth module 1021 of the first secondary lighting device 102. The Bluetooth module 1021 of the first secondary lighting device 102 may then connect to the Bluetooth module 1031 of the second secondary lighting device 103. Further, the Bluetooth module 1031 of the second secondary lighting device 103 may connect to the Bluetooth module 1041 of the third secondary lighting device 104. Therefore, a wireless transmitting linking path can be formed among the primary lighting device and the secondary lighting device(s).

The Bluetooth modules of the primary lighting device 101 and at least one secondary lighting device (for example, the first, second, and/or third secondary lighting devices 102/103/104), may connect to a single external device or connect to multiple external devices simultaneously.

The Bluetooth module 1011 of the primary lighting device 101 may be configured to receive a first audio data from the external device, and to send the first audio data to the first secondary lighting device 102, the second secondary lighting device 103 and/or the third secondary lighting device 104. The external device may be any smart device having a Bluetooth module, such as a computer, a cell phone, a music player, a tablet computer, etc.

The Bluetooth module 1011 of the primary lighting device 101 may relay the first audio data to the first secondary lighting device 102, the second secondary lighting device 103 and/or the third secondary lighting device 104. In one embodiment, The Bluetooth module 1011 of the primary lighting device 101 may send the first audio data to the first secondary lighting device 102. The Bluetooth module 1021 of the first secondary lighting device 102 may be configured to receive the first audio data from the primary lighting device 101 and to send the first audio data to the second secondary lighting device 103. Further, the Bluetooth module 1031 of the second secondary lighting device 103 may be configured to receive the first audio data from the first secondary lighting device 102 and to send the first audio data to the third secondary lighting device 103. The Bluetooth module 1041 of the third secondary lighting device 104 may be configured to receive the first audio data from the second secondary lighting device 103.

The audio broadcast modules 1012, 1022, 1032 and 1042 in the primary lighting device and the one or more secondary lighting devices, respectively, may be configured to broadcast the first audio data.

In the disclosed audio broadcast system using lighting devices, any lighting device may be used as a primary lighting device or a secondary lighting device without limitation. Any lighting device in the system may be functioned as a primary lighting device or a secondary lighting device. For example, one of a plurality of lighting devices may receive audio data from an external device, which may then be considered as the primary lighting device, while other lighting devices of the plurality of lighting devices in the system may be used as the secondary lighting devices.

In certain embodiments, the system may include a plurality of secondary lighting devices. As long as one of these secondary lighting devices can receive an audio signal, the audio signal may be transmitted or propagated through cascading layers of other secondary lighting devices, which extends the coverage range of the wireless network. Such wireless network may provide a self-organized network to transmit and broadcast the audio signals and to avoid using conventional transmitter station to perform signal transmission.

Therefore, in an exemplary embodiment, the disclosed system may include a plurality of lighting devices having audio broadcast capabilities to play same audio data. Such system may be used in various applications. For example, in a household, every room may be installed with one or more lighting devices each having audio broadcast capabilities. A user (e.g., house owner) or may operate a cell phone in one of the rooms to connect to the lighting device in this room via Bluetooth communication. For example, when the user plays Song 1 on the cell phone, the lighting devices in all rooms may play the Song 1 at the same time so that family members or users in other rooms may share the music.

In certain embodiments, the Bluetooth module of any one of the primary lighting device 101, the first secondary lighting device 102, the second secondary lighting device 103 and the third secondary lighting device 104 may be configured to receive a broadcast interruption command from an external device and to send the broadcast interruption command to the audio broadcast module of the same lighting device.

Alternatively, the Bluetooth module may send the broadcast interruption command to the audio broadcast modules of different lighting device(s) from the primary lighting device 101, the first secondary lighting device 102, the second secondary lighting device 103 and the third secondary lighting device 104.

For example, the Bluetooth module 1021 of the first secondary lighting device 102 may receive a broadcast interruption command from an external device. The Bluetooth module 1021 may either send the broadcast interruption command to the audio broadcast module 1022 of the first secondary lighting device 102, or send the broadcast interruption command to all the audio broadcast modules 1012, 1022, 1032 and 1042.

The audio broadcast modules of the primary lighting device and the one or more secondary lighting devices may be further configured to stop playing the first audio data when receiving the broadcast interruption command.

The broadcast interruption command may be from a same external device which sends the first audio data, or from a different external device. That is, a plurality of external devices may simultaneously connect to the Bluetooth module of any one of the primary lighting device and the one or more secondary lighting devices. For example, when the primary lighting device and the one or more secondary lighting devices are playing a first audio data from a first external device, and when the Bluetooth module of any one of these lighting devices receives a broadcast interruption command, the first audio data may be stopped from being played. The broadcast interruption command may be from the first external device that sends the first audio data, or from a second external device that is different from the first external device.

In certain embodiments, when the Bluetooth module of one of the lighting devices receives the broadcast interruption command, the Bluetooth module of one of the lighting devices may be pre-configured to send the broadcast interruption command to the audio broadcast module of this one lighting device itself, and/or send the broadcast interruption command to the audio broadcast modules of the primary lighting device 101, the first secondary lighting device 102, the second secondary lighting device 103 and the third secondary lighting device 104.

In an exemplary embodiment, the broadcast interruption command received by the Bluetooth module may only be sent to the audio broadcast module of the same one lighting device itself. For example, in a household where each room is equipped with a lighting device having audio broadcast capabilities. A family member in room A may want to stop the audio broadcast for certain reasons; the family member may operate a cell phone to send a broadcast interruption command to a lighting device A in room A. The lighting device A may receive the broadcast interruption command and stops broadcasting in room A.

In another exemplary embodiment, the broadcast interruption command received by the Bluetooth module may be sent to all the audio broadcast modules of lighting devices including the primary lighting device and the one or more secondary lighting devices. Still in the previous household example, a family member may send a broadcast interruption command to a lighting device in any one of the rooms, all the lighting devices in the household may stop audio broadcasting, so that the family member do not have to go to each room to turn off the music, which satisfies user requirements.

In certain embodiments, the Bluetooth module of any one of the primary lighting device 101, the first secondary lighting device 102, the second secondary lighting device 103 and the third secondary lighting device 104 may be configured to receive a second audio data from an external device, and to send the second audio data to the audio broadcast module of the same one lighting device itself. Alternatively, the Bluetooth module may be configured to send the second audio data to the audio broadcast modules of other lighting devices or all lighting devices from the primary lighting device and the one or more secondary lighting devices.

The audio broadcast modules of the primary lighting device and the one or more secondary lighting devices may be further configured to stop playing the first audio data and start playing the second audio data when receiving the second audio data.

The second audio data and the first audio data may be from a same external device, or from different external devices. For example, a plurality of external devices may simultaneously connect to the Bluetooth module of any one of the primary lighting device and the one or more secondary lighting devices. When the primary lighting device and the secondary lighting devices are playing a first audio data from a first external device, and when the Bluetooth module of any one of these lighting devices receives the second audio data, the first audio data is stopped, and the second audio data is played instead. The second audio data may be from the first external device, or from a second external device that is different from the first external device.

In certain embodiments, the Bluetooth module of any one of the primary lighting device and the secondary lighting devices may be configured to receive a second audio data from an external device, and to send the second audio data to the audio broadcast module of the one lighting device itself. Alternatively, the Bluetooth module may be configured to send the second audio data to the audio broadcast modules of all other lighting devices or all lighting devices from the primary lighting device and the one or more secondary lighting devices.

In an exemplary embodiment, the second audio data received by the Bluetooth module of one lighting device may only be sent to the audio broadcast module of the same one lighting device itself. For example, in a household, each room may be equipped with a lighting device having audio broadcast capabilities. When a family member in one of the rooms (room B) does not like Song 1 currently being played, the family member may operate a cell phone to play Song 2 on the cell phone. A lighting device B in room B may play Song 2 while other rooms may still play Song 1, fulfilling the customization needs of the family members in different rooms.

In another exemplary embodiment, the second audio data received by the Bluetooth module may be sent to all the audio broadcast modules of the primary lighting device and the secondary lighting devices. In the previous household example, when switching songs, a family member may connect a cell phone to one lighting device in one of the rooms and play Song 2 on the cell phone, all the lighting devices in the household may stop playing Song 1 and start playing Song 2, so that the family member do not have to go to each room to switch music, which facilitates user operation.

In certain embodiments, the primary lighting and the one or more secondary lighting devices may be LED lights.

In various embodiments, the Bluetooth module of the primary lighting device and the one or more secondary lighting devices may be configured to receive control signals from an external device. The control signals may include audio control signals and light control signals. For example, the audio control signals may include turning the audio broadcast on/off, adjusting audio volume, adjusting sound equalizer according to user preference, etc. The light control signals may include switching the light on/off, adjusting brightness, color and color temperature of the light according to user preference or according to different music styles, etc. Further, the external device may install an Application that provides a user interface to configure the light control signals and the audio control signals separately or in combinations.

Figure 2:
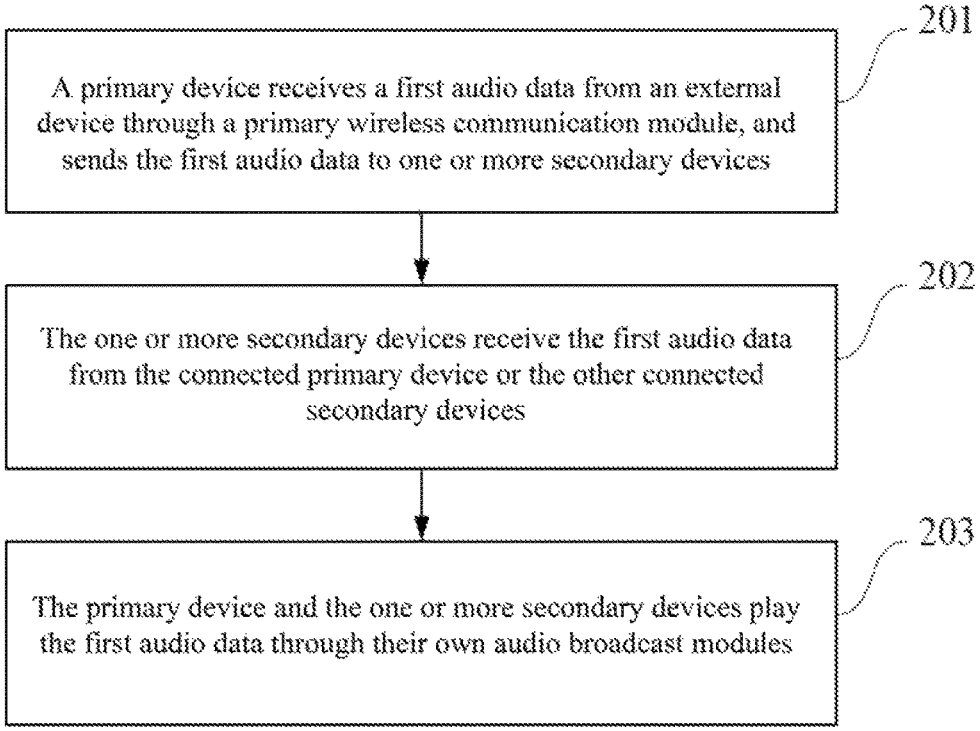
FIG. 2 is a flowchart illustrating an exemplary audio broadcast method consistent with various embodiments the present disclosure.

FIG. 2 is a flowchart illustrating an exemplary audio broadcast method consistent with various disclosed embodiments of the present disclosure. As shown in FIG. 2, in an exemplary process, a primary device receives a first audio data from an external device through a primary wireless communication module, and sends the first audio data to one or more secondary devices (Step 201). The one or more secondary devices receive the first audio data from the connected primary device or the other connected secondary devices (Step 202). The primary device and the one or more secondary devices play the first audio data through their own audio broadcast modules (Step 203).

Below is an embodiment of the disclosed audio broadcast method using lighting devices. It should be noted that, a lighting device in the following embodiment can be replaced with other types of smart appliances having audio broadcast and wireless communication capabilities. That is, a primary lighting device can be any smart appliance that qualifies as the primary device, and a secondary lighting device can be any smart appliance that qualifies as the secondary device. Further, a Bluetooth module can be replaced by a WiFi module or a communication module having both Bluetooth and WiFi functionalities.

In Step 201, a primary lighting device may receive a first audio data from an external device through a Bluetooth module, and send the first audio data to one or more secondary lighting devices. The primary lighting device and the one or more secondary lighting devices may form a wireless transmitting linking path through the Bluetooth modules.

The external device may be any smart device having a Bluetooth module, such as a computer, a cell phone, a music player, a tablet computer, etc. The primary lighting device may relay the first audio data to the one or more secondary lighting devices.

In Step 202, at least one secondary lighting device may receive the first audio data from connected lighting device (s), including the primary lighting device and/or the other secondary lighting devices.

In an exemplary embodiment having three secondary lighting devices, the primary lighting device may send the first audio data to a first secondary lighting device that is connected to the primary lighting device. The first secondary lighting device may receive the first audio data and send the first audio data to a second secondary lighting device. Further, the second secondary lighting device may receive the first audio data and send the first audio data to a third secondary lighting device. The third secondary lighting device may be configured to receive the first audio data.

In Step 203, the primary lighting device and the one or more secondary lighting devices may be configured to play the first audio data through their own audio broadcast modules.

Therefore, in an exemplary embodiment, the disclosed method may employ a plurality of lighting devices having audio broadcast capabilities to play the same audio data, and to be used in various applications. For example, in a household, every room is provided with a lighting device having audio broadcast capabilities. The house owner or a user may operate a cell phone in one of the rooms to connect to one lighting device in this room via Bluetooth communication. The owner may play Song 1 on the cell phone, and then the lighting devices in all rooms may play Song 1 at the same time so that family members in other rooms may share the song.

Optionally, the disclosed audio broadcast method may further include additional steps. In one additional step, the Bluetooth module of any one of the primary lighting device and the one or more secondary lighting devices may receive a broadcast interruption command from an external device, and send the broadcast interruption command to the audio broadcast module of the same one lighting device. Alternatively, the Bluetooth module may send the broadcast interruption command to the audio broadcast modules of some or all lighting devices of the primary lighting device and the one or more secondary lighting devices.

In certain embodiments, when the Bluetooth module of any one of the lighting devices receives the broadcast interruption command, the Bluetooth module of one of the lighting devices may be pre-configured to send the broadcast interruption command to the audio broadcast module of this one lighting device, and/or to send the broadcast interruption command to the audio broadcast modules of the primary lighting device and the one or more secondary lighting devices.

In one additional step, the audio broadcast module of the lighting device that receives the broadcast interruption command may stop playing the first audio data.

The broadcast interruption command may be from the same external device that sends the first audio data, or from a different external device. For example, a plurality of external devices may simultaneously connect to the Bluetooth module of any one of the primary lighting device and the secondary lighting devices. When the primary lighting device and the secondary lighting devices are playing a first audio data from a first external device, and when the Bluetooth module of any lighting devices receives the broadcast interruption command, the first audio data are stopped from playing. The broadcast interruption command may be from the first external device, or from a second external device that is different from the first external device.

In an exemplary embodiment, the broadcast interruption command received by the Bluetooth module may only be sent to the audio broadcast module of the same one lighting device itself. For example, in a household, each room may be equipped with a lighting device having audio broadcast capabilities. When a family member in room A wants to stop the audio broadcast, the family member may operate a cell phone to send a broadcast interruption command to a lighting device A in room A. The lighting device A may receive the broadcast interruption command and stops broadcasting in room A.

In another exemplary embodiment, the broadcast interruption command received by the Bluetooth module may be sent to all the audio broadcast modules of lighting devices including the primary lighting device and the secondary lighting devices. As in the previous household example, a family member may send a broadcast interruption command to a lighting device in any one of the rooms, all the lighting devices in the household may stop audio broadcasting, so that the family member do not have to go to each room to turn off the music, which satisfies user requirements.

Optionally, the disclosed audio broadcast method may further include more additional steps.

In an exemplary additional step, the Bluetooth module of any one of the primary lighting device and the secondary lighting devices may be configured to receive a second audio data from an external device, and to send the second audio data to the audio broadcast module of the same one lighting device itself. Alternatively, the Bluetooth module may be configured to send the second audio data to the audio broadcast modules of other lighting devices or all lighting devices from the primary lighting device and the one or more secondary lighting devices.

In certain embodiments, when the Bluetooth module of one of the lighting devices receives the second audio data, the Bluetooth module of one of the lighting devices may be pre-configured to send the second audio data to the audio broadcast module of this one lighting device itself, and/or send the second audio data to the audio broadcast modules of the primary lighting device and the one or more secondary lighting devices.

In another additional step, when an audio broadcast module of a lighting device receives the second audio data, the audio broadcast module may stop playing the first audio data and start playing the second audio data.

The second audio data and the first audio data may be from a same external device, or may be from different external devices. For example, a plurality of external devices may simultaneously connect to the Bluetooth module of any one of the primary lighting device and the secondary lighting devices. For example, when the primary lighting device and the secondary lighting devices are playing a first audio data from a first external device, and when the Bluetooth module of any lighting devices receives the second audio data, the first audio data is stopped and the second audio data is played. The second audio data may be from the first external device, or from a second external device that is different from the first external device.

In an exemplary embodiment, the second audio data received by the Bluetooth module of one lighting device may only be sent to the audio broadcast module of the same one lighting device. For example, in a household where each room is equipped with a lighting device having audio broadcast capabilities. A family member in one of the rooms (room B) does not like Song 1 currently being played, the family member may operate a cell phone to play Song 2 on the cell phone. A lighting device B in room B may play Song 2 while other rooms may still play Song 1, fulfilling the customization needs of the family members in different rooms.

In another exemplary embodiment, the second audio data received by the Bluetooth module may be sent to all the audio broadcast modules of the primary lighting device and the secondary lighting devices. In the previous household example, when switching songs, a family member may connect a cell phone to one lighting device in one of the rooms and play Song 2 on the cell phone, all the lighting devices in the household may stop playing Song 1 and start playing Song 2 instead, so that the family member do not have to go to each room to switch music. This facilitates easy user operations.

In another exemplary embodiment, the control functions of the lighting devices may be implemented in combination with the audio broadcasting functions. In the previous household example, when switching songs, a family member may connect a cell phone to one lighting device in one of the rooms and play Song 2 on the cell phone. At the same time, the lighting device in that room may show a lighting signal (e.g., a flash or a light color change for a short period of time) to indicate that the cell phone has established a connection with the lighting device. Through the cell phone, the user may control all the lighting devices in the household and stop playing Song 1 and start playing Song 2 instead, so that the family member do not have to go to each room to switch music, which facilitates user operation. Further, the lighting device in that room may again display a lighting signal (e.g., a flash or a light color change for a short period of time) to indicate the change of the songs.

In another example, a family member in one of the rooms (room B) may not like Song 1 that is currently being played; the family member may operate a cell phone to play Song 2 on the cell phone. A lighting device B in room B may play Song 2 while other rooms may still play Song 1, fulfilling the customization needs of the family members in different rooms. Further, the lighting device B may display a lighting signal (e.g., a flash or a light color change for a short period of time) to indicate the change of the songs.

In addition, when user changes music played in one or more rooms, the user may define the lighting signals/adjustments associated with the music change. For example, a user may associate the new piece of music to a warmer or cooler color of light generated by one or more of the lighting devices. In one example, a user may change to a new song, and adjust a first lighting device to a warmer color of light (e.g., the lighting device in the kitchen) and a second lighting device to a cooler color of light (e.g., the lighting device in a study) while the system switches to a new song.

In another embodiment, the lighting devices may include sensors, such as motion sensors, temperature sensors, lighting sensors, etc. The lighting and audio broadcasting system may incorporate the readings of the sensors into the audio and lighting control functions. For example, a primary lighting device consistent with the present disclosure may be the lighting device located in the foyer of a house. The primary lighting device may include a motion sensor. When the primary and secondary lighting devices are playing music in the house, the sensor in the primary device may monitor the motion at the front door. If the door opens, the sensor may detect that motion. The primary lighting device may generate an interrupt signal, which may pause the music for a pre-set period of time or a user-defined period of time. The primary lighting device may also generate an interrupt signal and switch to a piece of music (e.g., a third audio data) to welcome the person at the door.

Other sensors, such as temperature sensors, air quality sensors, light sensors, etc. can also be incorporated into the lighting and audio broadcasting system. The sensors can be integrated into the primary and/or second lighting devices. The data read from the sensors can be used to control the lighting and audio broadcasting system. In another example, the primary lighting device may be the lighting device located in the kitchen. The primary lighting device may include an air quality sensor. If the air quality changes (e.g., having smoke in the kitchen), the primary lighting device may incorporate that information and adjust the lighting (e.g., flash) together or separately with the audio signals (e.g., adjusting the volume of music or pause the music).

Various embodiments of the present disclosure may be implemented by software products or combinations of software products and hardware. For example, various modules/devices in the present disclosure may employ application specific integrated circuit (ASIC), or other similar hardware to achieve desired functions. In one embodiment, a software program may be executed by a processor to achieve the previously described steps and functions. Further, the software program and related data structure may be stored in a computer-readable recording medium, such as RAM memory, magnetic or optical drive, a floppy disk, etc. In addition, some disclosed steps and functions may be implemented by hardware, such as electrical circuits configured to cooperate with the processor and execute various steps and functions.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

The disclosed methods and systems for audio broadcast may solve technical problems related to using conventional bulky and expensive specific wireless transmitter station to play music stored in a smart terminal connected to smart appliances (e.g., LED lighting devices), which limits applications of appliances with audio broadcast capabilities. The disclosed methods and systems for audio broadcast may broad application scenarios of smart appliances with audio broadcast capabilities.

As disclosed, a primary device and one or more secondary devices may form a wireless transmitting network through their wireless communication modules. When receiving a first audio data, the primary wireless communication module of the primary device may transmit the first audio data to the one or more secondary devices. Therefore, the primary device and the one or more secondary devices may play the same audio data. In other embodiments, the primary device and the one or more secondary devices may be controlled to, individually or in groups, play the same or different audio data. The disclosed system may be used in various applications.

What is claimed is:

1. An audio broadcast system, comprising:

a primary device including a primary wireless communication module and an audio broadcast module; and one or more secondary devices each including a secondary wireless communication module and an audio broadcast module, wherein:

the primary device and the one or more secondary devices are connected to form a wireless transmitting linking path through the primary wireless communication module of the primary device and one or more secondary wireless communication modules of the one or more secondary devices;

the primary device is configured to receive a first audio data from an external device, and to send the first audio data to the one or more secondary devices by using the primary wireless communication module;

the secondary wireless communication module of each of the one or more secondary devices is configured to receive the first audio data from the primary device or from a different connecting secondary device;

the audio broadcast modules of the primary device and the one or more secondary devices are configured to broadcast the first audio data;

one of the primary wireless communication module and the secondary wireless communication module is configured to: receive a second audio data from the external device; and to send the second audio data to the audio broadcast modules of the primary device and the one or more secondary devices; and the audio broadcast modules that receive the second audio data are configured to stop playing the first audio data and start playing the second audio data when receiving the second audio data.

2. The system according to claim 1, wherein the primary wireless communication module of the primary device and the secondary wireless communication module of the one or more secondary devices are configured to connect to a single external device, or connect to a plurality of external devices simultaneously.

3. The system according to claim 1, wherein:

one of the primary wireless communication module and the secondary wireless communication module is further configured: to receive a broadcast interruption command from the external device, and to send the broadcast interruption command to the audio broadcast module of at least one of the primary device and the one or more secondary devices; and the audio broadcast module of the at least one of the primary device and the one or more secondary device is configured to stop playing the first audio data when receiving the broadcast interruption command.

4. The system according to claim 1, wherein at least one of the primary device and the one or more secondary devices is an LED lighting device.

5. The system according to claim 1, wherein:

the primary wireless communication module of the primary device supports Bluetooth communication, WiFi communication, or a combination of Bluetooth communication and WiFi communication; and the secondary wireless communication module of each of the one or more secondary devices is a Bluetooth module or a WiFi module.

6. The system according to claim 5, wherein:

the primary wireless communication module is further configured to receive the first audio data from the external device through one of the Bluetooth communication and the WiFi communication; and send the first audio data to the one or more secondary devices by communicating with the Bluetooth module or the WiFi module of the secondary wireless communication module.

7. The system according to claim 5, wherein:

the primary wireless communication module supports cellular data communication and is further configured to receive the first audio data from the external device through the cellular data communication.

8. The system according to claim 1, wherein:

the primary device further includes: an audio input unit configured to receive the first audio data from the external device through a physical connection interface; and the audio input unit includes at least one of a memory card slot, a USB port, an auxiliary audio input port, multichannel analog audio input ports, or an optic audio input port.

9. The system according to claim 8, wherein the primary device further includes a main processing unit, when the external device transmits an analog audio signal to the audio input unit or the primary wireless communication module, the main processing unit configured to:

process the analog audio signal received by the audio input unit or the primary wireless communication module, convert the analog audio signal to digital audio data, and send the digital audio data to the primary wireless communication module for broadcasting to the one or more secondary devices.

10. The system according to claim 8, wherein the primary device further includes: an optical audio module configured to receive a digital audio signal from the optic audio input port of the audio input unit, and process and send the digital audio signal to the primary wireless communication module for broadcasting to the one or more secondary devices.

11. An audio broadcast method, comprises:

providing a primary device including a primary wireless communication module and an audio broadcast module, and one or more secondary devices each including a secondary wireless communication module and an audio broadcast module, wherein the primary device and the one or more secondary devices are connected to form a wireless transmitting linking path through the primary wireless communication module of the primary device and one or more secondary wireless communication modules of the one or more secondary devices;

receiving, by the primary device, a first audio data from an external device;

sending, by the primary wireless communication module of the primary device, the first audio data to the one or more secondary devices through the wireless transmitting linking path;

receiving, by the secondary wireless communication module of at least one of the one or more secondary devices, the first audio data from the primary device or from a different secondary device of the one or more secondary devices, connected to the one or more secondary devices;

broadcasting, by the audio broadcast modules of the primary device and the one or more secondary devices, the first audio data;

receiving, by one of the primary wireless communication module and the secondary wireless communication module, a second audio data from the external device;

sending, by the one of the primary wireless communication module and the secondary wireless communication module, the second audio data to the audio broadcast modules of the primary device and the one or more secondary devices; and stopping playing the first audio data and starting to play the second audio data by the audio broadcast modules that receive the second audio data.

12. The method according to claim 11, further comprising:

receiving, by one of the primary wireless communication module and the secondary wireless communication module, a broadcast interruption command from the external device;

sending, by the one of the primary wireless communication module and the secondary wireless communication module, the broadcast interruption command to the audio broadcast module of all of the primary device and the one or more secondary devices; and stopping playing the first audio data, by the audio broadcast modules that receive the broadcast interruption command.

13. The method according to claim 11, wherein:

the primary wireless communication module of the primary device supports Bluetooth communication, WiFi communication, or a combination of Bluetooth communication and WiFi communication; and the secondary wireless communication module of each of the one or more secondary devices is a Bluetooth module or a WiFi module.

14. The method according to claim 13, further comprising:

receiving, by the primary wireless communication module of the primary device, the first audio data from the external device through one of the Bluetooth communication and the WiFi communication; and sending, by the primary wireless communication module, the first audio data to the one or more secondary devices by communicating with the Bluetooth module or the WiFi module of the secondary wireless communication module.

15. The method according to claim 13, wherein:

the primary wireless communication module supports cellular data communication; and the method further comprises: receiving, by the primary wireless communication module, the first audio data from the external device through the cellular data communication.

16. The method according to claim 11, further comprising:

receiving, by an audio input unit of the primary device, the first audio data from the external device through a physical connection interface;

wherein the audio input unit includes at least one of a memory card slot, a USB port, an auxiliary audio input port, multi-channel analog audio input ports, or an optic audio input port.

17. The method according to claim 16, further comprising: when the external device transmits an analog audio signal to the audio input unit or the primary wireless communication module, processing, by a main processing unit of the primary device, the analog audio signal received by the audio input unit or the primary wireless communication module;

converting, by the main processing unit, the analog audio signal to digital audio data; and sending, by the main processing unit, the digital audio data to the primary wireless communication module for broadcasting to the one or more secondary devices.

18. The method according to claim 16, further comprising:

receiving, by an optical audio module of the primary device, a digital audio signal from the optic audio input port of the audio input unit, and processing and sending, by the optical audio module, the digital audio signal to the primary wireless communication module for broadcasting to the one or more secondary devices.

19. An audio broadcast system, comprising:

a primary device including: a primary wireless communication module, an audio broadcast module, an audio input unit, and an optical audio module;

one or more secondary devices each including a secondary wireless communication module and an audio broadcast module, wherein:

the primary device and the one or more secondary devices are connected to form a wireless transmitting linking path through the primary wireless communication module of the primary device and one or more secondary wireless communication modules of the one or more secondary devices;

the primary device is configured to receive a first audio data from an external device, and to send the first audio data to the one or more secondary devices by using the primary wireless communication module;

the secondary wireless communication module of each of the one or more secondary devices is configured to receive the first audio data from the primary device or from a different connecting secondary device;

the audio broadcast modules of the primary device and the one or more secondary devices are configured to broadcast the first audio data;

the audio input unit includes an optic audio input port, configured to receive the first audio data from the external device through a physical connection interface; and the optical audio module is configured to receive a digital audio signal from the optic audio input port, and process and send the digital audio signal to the primary wireless communication module for broadcasting to the one or more secondary devices.

* * * * *